US012778362B2

(12) United States Patent
Demmel

(10) Patent No.: US 12,778,362 B2
(45) Date of Patent: Nov. 3, 2026

(54) FASTENING DEVICE FOR A SEAT FITTING OR LID FITTING ON A SANITARY OBJECT, AND SANITARY ARRANGEMENT COMPRISING A SANITARY OBJECT AND A SEAT FITTING OR LID FITTING

(71) Applicant: Duravit Aktiengesellschaft, Hornberg (DE)

(72) Inventor: Rüdiger Demmel, Frasdorf (DE)

(73) Assignee: DURAVIT AKTIENGESELLSCHAFT, Hornberg (DE)

( * ) Notice: Subject to any disclaimer, the term of this patent is extended or adjusted under 35 U.S.C. 154(b) by 237 days.

(21) Appl. No.: 18/522,623

(22) Filed: Nov. 29, 2023

(65) Prior Publication Data

US 2024/0188774 A1 Jun. 13, 2024

(30) Foreign Application Priority Data

Dec. 8, 2022 (DE) ..... 10 2022 132 678.0

(51) Int. Cl.
*A47K 13/26* (2006.01)
*A47K 13/00* (2006.01)
*A47K 13/24* (2006.01)

(52) U.S. Cl.
CPC ..... *A47K 13/26* (2013.01); *A47K 13/00* (2013.01); *A47K 13/247* (2013.01)

(58) Field of Classification Search
CPC ..... A47K 13/26; A47K 13/00; A47K 13/247
See application file for complete search history.

(56) References Cited

U.S. PATENT DOCUMENTS

| | | | | |
|---|---|---|---|---|
| 8,656,522 | B2 * | 2/2014 | Leibfried | A47K 13/26 4/236 |
| 11,896,172 | B2 * | 2/2024 | Stammel | A47K 13/12 |
| 2021/0153703 | A1 | 5/2021 | Stammel | |

FOREIGN PATENT DOCUMENTS

| | | | | |
|---|---|---|---|---|
| CH | 375861 | A | 3/1964 | |
| DE | 202004010520 | U1 | 9/2004 | |
| EP | 2215313 | B1 * | 11/2012 | E03D 11/14 |
| EP | 2803308 | A1 | 11/2014 | |

(Continued)

OTHER PUBLICATIONS

Canadian Patent Office issued an Office Action on Apr. 4, 2025 regarding parallel Canadian Patent Application No. 3,222,481, 4 Pages.

(Continued)

*Primary Examiner* — Jennifer C Chiang
(74) *Attorney, Agent, or Firm* — LUCAS & MERCANTI, LLP; Klaus P. Stoffel

(57) ABSTRACT

A fastening device for a seat fitting or lid fitting on a sanitary object, comprising a threaded rod which has an external threaded portion and an internal threaded bore and which engages through a through-hole in the sanitary object in the mounted position, a first and a second abutment element which in the mounted position receive a portion of the sanitary object between one another and are braced thereagainst, at least one nut to be screwed onto the external threaded portion for bracing the abutment elements and the threaded rod, and a retaining pin which receives the seat fitting or lid fitting and which has an external threaded portion to be screwed into the internal threaded bore.

21 Claims, 9 Drawing Sheets

(56) References Cited

FOREIGN PATENT DOCUMENTS

| | | | | | |
|---|---|---|---|---|---|
| EP | 3742009 | A1 | | 11/2020 | |
| EP | 3797661 | B1 | | 12/2021 | |
| GB | 2309040 | A | * | 7/1997 | ..... A47K 13/26 |
| WO | 2016070707 | A1 | | 5/2016 | |

OTHER PUBLICATIONS

European Search Report Dated Apr. 26, 2024, EP23210350, 2 Pages.
Chinese Patent Office issued an Office Action dated Dec. 19, 2025 regarding parallel Chinese Patent Application No. 202311655234.5, 11 Pages.
German Office Action Dated Oct. 25, 2023, DE 102022132678.0, 5 Pages.

* cited by examiner

FASTENING DEVICE FOR A SEAT FITTING OR LID FITTING ON A SANITARY OBJECT, AND SANITARY ARRANGEMENT COMPRISING A SANITARY OBJECT AND A SEAT FITTING OR LID FITTING

CROSS-REFERENCE TO RELATED APPLICATIONS

The present application claims priority of DE 10 2022 132 678.0, filed Dec. 8, 2022, the priority of this application is hereby claimed, and this application is incorporated herein by reference.

BACKGROUND OF THE INVENTION

The invention relates to a fastening device for a seat fitting or lid fitting on a sanitary object.

Generally, a seat fitting or lid fitting is fastened to a sanitary object in the form of a WC, urinal or bidet, wherein the seat fitting or lid fitting generally has a seat, optionally also a lid, or only a lid. On the sanitary object, which is usually produced from sanitary ware, the seat fitting or lid fitting is generally fastened by means of suitable fastening devices to a rear upper face of the sanitary object, i.e. in the vicinity of the wall, in the mounted position. Such a fastening device generally comprises a fastening rod which is inserted through a through-hole provided on the sanitary object. The fastening rod is provided with an external thread so that a retaining nut can be screwed from the inner face of the sanitary object, i.e. onto the rod portion which has been pushed therethrough. On the opposing exposed upper face of the sanitary object, the fastening rod is either positioned by a corresponding disk-shaped collar or is supported via a screwed-on abutment disk or the like, so that the sanitary object is correspondingly braced and the fastening rod is fixed. The sanitary object has two corresponding through-holes so that two such fastening rods can be mounted.

The seat fitting or lid fitting is then fastened on the threaded rod ends protruding upwardly on the upper face of the sanitary object. To this end, corresponding hinges with fastening portions which have through-bores or blind bores, by which they are pushed onto the rod ends, are provided on the seat fitting or lid fitting, wherein a corresponding latching or clamped retention is achieved thereby. Such hinges can be formed, for example, by means of two fluid rotational dampers which have two portions which are rotatable relative to one another and which are damped by a fluid, wherein the one portion is fixedly connected to the seat fitting, while the other portion has the through-bore or blind bore and is pushed onto the rod end.

The mounting of the fastening devices, i.e. the fastening rods, and also the mounting of the seat fitting or lid fitting only takes place in situ when the WC, urinal or bidet is mounted at the customer's premises. To this end, the two fastening devices are initially fastened to the sanitary object, the sanitary object being mounted thereafter on the wall. Only then is the seat fitting or lid fitting pushed onto the fastening devices. A drawback here is that the fitter has to position and align the fastening devices in situ, since generally the through-holes provided in the ceramic have a relatively large diameter, for example in the region of 1-2 cm, i.e. the position of the fastening devices, respectively the fastening rods, is ultimately variable. The fitter is thus obliged, on the one hand, to set the spacing of the two fastening rods exactly relative to one another such that it corresponds to the spacing of the fastening elements, respectively the through-bores or blind bores, provided on the seat fitting, so that they can be easily pushed on. Moreover, the alignment of the fastening devices has to be accurate, both on the two sides and also at the front and at the rear, so that the subsequently mounted seat fitting is also positioned exactly symmetrically on the sanitary object. This is associated, therefore, with a significantly high degree of effort and often results in an exactly symmetrical arrangement of the seat fitting or lid fitting not being provided. Indeed there might be the possibility of already mounting the fastening devices on the sanitary object in the factory, so that these fastening devices are correctly positioned and aligned. In this case, however, the fastening rods protrude from the ceramic upper face and the protruding rod length is ca. 2-4 cm. On the one hand, this leads to packaging difficulties since it has to be ensured that the protruding rod ends are correspondingly protected. It also results in handling difficulties since the rod ends are exposed and during the course of handling, in particular during mounting, can strike against other objects or the fitter can come into contact therewith and be injured.

SUMMARY OF THE INVENTION

The object of the invention is thus to specify an improved fastening device.

To solve this problem, according to the invention a fastening device is provided for a seat fitting or lid fitting on a sanitary object, comprising a threaded rod which has an external threaded portion and an internal threaded bore and which engages through a through-hole in the sanitary object in the mounted position, a first and a second abutment element which in the mounted position receive a portion of the sanitary object between one another and are braced thereagainst, at least one nut to be screwed onto the external threaded portion for bracing the abutment elements and the threaded rod, and a retaining pin which receives the seat fitting and which has an external threaded portion to be screwed into the internal threaded bore.

In contrast to the prior art, the fastening device according to the invention is characterized in that a one-piece fastening rod is not provided but, so to speak, a two-piece fastening rod. This fastening rod is formed firstly from the threaded rod and secondly from the retaining pin which can be screwed thereto. For mounting the fastening device, the threaded rod is initially pushed through a corresponding through-hole in the sanitary object and a first abutment element is positioned on the inner face of the sanitary object and a second abutment element is positioned on the outer face, a nut being screwed thereafter onto an external threaded portion of the threaded rod which is accessible from the ceramic inner face and the ceramic portion located between the abutment elements being braced between the abutment elements by said nut. In the mounted position, the threaded rod is virtually flush with the abutment element which in turn is positioned on the ceramic upper face and ultimately only slightly protrudes thereover. In any case, the threaded rod which is mounted in such a manner does not noticeably protrude from the ceramic upper face. Only when the seat fitting or lid fitting actually has to be mounted is the retaining pin screwed with its external thread into the internal threaded bore of the threaded rod, which is accessible from the ceramic upper face, so that the fastening rod is finally completed and together with the retaining pin a fastening portion protruding from the upper face is produced, the fastening element on the fitting side then being able to be pushed thereon.

This multi-part configuration of the fastening device provides the advantage of pre-mounting the essential device elements in the factory, without involving the drawbacks described in the introduction regarding special packaging or potential handling and injury problems. This is because it is possible to mount the threaded rod, in addition to the two abutment elements, and to align them accurately in a simple manner in the factory, so that the threaded rods and therewith the internal threaded bores are optimally positioned when mounted. The sanitary object which is pre-fitted in this manner can then be easily packaged and correspondingly handled when mounted, until the WC, urinal or bidet is mounted on the wall, since the pre-mounted fastening device parts do not protrude or form a structure relative to the ceramic upper face. Only then are the retaining pins screwed into the internal threaded bores and thus the fastening portions, onto which the seat fitting is pushed, are provided. Due to the optimal alignment of the threaded rods, the retaining pins are also inevitably optimally positioned thereby so that the seat fitting is then inevitably optimally aligned and positioned. This signifies a considerable simplification for the fitter, since the fitter only has to screw in the retaining pins and push on the seat fitting in situ and any other specific alignment operations, or the like, are no longer required.

In a development of the invention, the threaded rod can have a support portion by which it can be clamped against the second abutment element when the nut is screwed on. Via this support portion the threaded rod is mounted and supported against the second abutment element on this side. The second abutment element is thus a separate component. Alternatively, the second abutment element can be configured in one piece with the threaded rod. The threaded rod thus has a terminal collar which protrudes radially and which, forming the second abutment element, is supported against the upper face of the sanitary object in the mounted position.

The first abutment element or the first and the second abutment element are preferably designed either as a disk or as a plate. They are correspondingly dimensioned in terms of diameter or in terms of width or length such that it is ensured that, irrespective of the final position in which the threaded rod is arranged, sufficient support is always provided on the sanitary object.

The first and/or the second abutment element can also be captively retained on the threaded rod. This permits simple mounting, since the respective captively retained abutment element does not have to be separately handled and positioned. In particular, the second abutment element is expediently captively retained, which can be carried out, for example, by clinching or bonding. However, as described, it is also conceivable that the second abutment element is configured in one piece with the threaded rod, i.e. designed as a protruding collar, so that in this case a separate abutment element would not have to be secured.

The first abutment element is in any case a separate component. As described, this first abutment element can be designed as a separate disk or plate and during the course of mounting, when the threaded rod is pushed through the through-hole, it can also be pushed from the ceramic inner face onto the threaded rod and fixed by the nut. An expedient alternative of the invention provides that the first abutment element has an elongated slot through which the threaded rod engages, so that the abutment element can be tilted toward the threaded rod. This design as a type of toggle fastener makes it possible to push the first abutment element onto the threaded rod before the positioning thereof and to secure it with the nut. For the mounting, the first abutment element has to be moved into a mounted position in which it is tilted toward the threaded rod. In this position, the arrangement of the threaded rod and first abutment element has a narrow shape and can be guided through the through-hole. Then the first abutment element automatically tilts out again and thus protrudes on the two sides from the threaded rod and engages behind the sanitary object so that when the nut is tightened it is clamped thereagainst. The possibility of tilting is achieved by the configuration of the corresponding elongated slot.

If a support portion is provided on the threaded rod, and thus a separate second abutment element is used, this support portion is expediently implemented by means of a shoulder provided on the end of the threaded rod, the threaded rod bearing thereby against the second abutment element. This shoulder can be designed to be relatively thin, since it merely serves for support and does not take up any other load during operation. Particularly preferably in this context, the second abutment element has a recess for countersunk reception of the shoulder. It can be ensured thereby, with the shoulder arranged on the end of the threaded rod and the countersunk reception, that the threaded rod ultimately terminates flush with the second abutment element, i.e. the disk or plate, and accordingly does not protrude to any extent beyond the abutment plane. The shoulder can be conical, for example, while the recess has a countersink of compatible shape.

As described, the fastening device is tightened on the lower or inner face via the nut which is screwed onto the threaded portion. In order to be able to brace the elements correspondingly axially, an expedient development of the invention provides that the threaded rod has a receiver for positioning a tool, it being possible via the receiver to engage with a tool on the nut, on the one hand, and with a further tool on the threaded rod, so as merely to secure this threaded rod while the nut is being screwed on, or so as to secure the nut and actively to screw the threaded rod, or correspondingly to screw both together. To this end, the receiver can be designed as a slot which is provided on the front face of the threaded rod in which a screwdriver can be engaged. Alternatively, the receiver can also be designed as a polygonal recess extending into the internal threaded bore, i.e. for example as an internal hexagon for receiving an Allen key.

The second abutment element, whether as a separate component or as a one-piece threaded rod component, is arranged on the surface of the sanitary object which is generally coated with a glaze. In order to avoid the glaze being scratched in the course of mounting, it is conceivable to provide a surface protector. To this end, the second abutment element can have a bearing portion which is made of a softer material, such as a plastics material, and which bears against the sanitary object. The second abutment element can thus be provided on one side with a plastics coating which, for example, is sprayed on or bonded on. In comparison with the metal from which the second abutment element is made, this significantly softer plastics portion effectively prevents a direct metal-glaze contact and scratches are avoided. Alternatively, the second abutment element can be supported against the sanitary object via a bearing disk which is made, for example, of a plastics material. In other words, the soft contact washer is first located on the glazed surface, followed by the second abutment element. As a result, a direct glaze-metal contact is also avoided here.

As described, the respective retaining pin is screwed with its external thread into the internal threaded bore only in the course of the final mounting of the seat fitting. In order to be able to tighten the retaining pin sufficiently that an inadvertent release is prevented, the retaining pin expediently has a receiver for positioning a tool. Such a receiver can be, for example, a slot which is provided on the front face of the retaining pin and in which a screwdriver can engage. It is also conceivable that the retaining pin has a polygonal pin section on which a wrench can engage.

The retaining pin itself advantageously has one or more clamping or latching elements for a clamped or latching retention of the seat fitting. Such a clamping or latching element can be, for example, a clamping ring made of plastics or metal which is snapped into a groove on the retaining pin and which has a slightly larger external diameter than the through-bore or blind bore on the fastening element of the seat fitting. However, it is also conceivable simply to provide a groove on the pin as such a clamping or latching element, a latching element, which is provided on the fastening device of the seat fitting, being snapped therein when pushed on.

A cover can also be provided, the cover being placed on the second abutment element and covering this second abutment element in the mounted position, and the retaining pin engaging therethrough. This cover, which is also correspondingly designed to be round, thus covers the second abutment element when the second abutment element is designed as a round disk or round collar. It is conceivable that the cover also has a corresponding sleeve-like portion in which the retaining pin engages in some portions so that the retaining pin is virtually concealed if it is not engaged in the fastening device of the seat fitting. The fastening device of the seat fitting can also be supported on the cover, for which purpose the cover can be designed to be rounded at the upper end, for example, when the pushed-on portion of the fastening device on the fitting side has a cylindrical external shape, resulting in a virtually positive reception.

In addition to the fastening device, the invention further relates to a sanitary arrangement comprising a sanitary object and a seat fitting which is fastened to the sanitary object by means of two fastening devices of the type described above. The sanitary object, for example a WC, urinal or bidet, has in the rear region of the ceramic upper face two corresponding generally circular through-holes in which the fastening devices can be mounted. Preferably, the two through-holes are fully covered in the mounted position by the second abutment elements, but alternatively this full covering can also be implemented by the optionally provided cover. The through-holes in any case are no longer visible in the final mounted position.

The seat fitting or lid fitting can simply be a pivotable seat or lid, such as for example in the case of a bidet or urinal. Alternatively, it can be a seat-lid combination as is expedient, in particular, in a WC.

Two rotational dampers, which in each case have a connecting portion with a retaining pin receiver into which the respective retaining pin engages, can also be fastened to the seat fitting or lid fitting. The retaining pin receiver, which is generally implemented in the form of a through-bore or blind bore, permits the rotational damper, which is generally designed as a fluid damper, to be simply pushed onto the respective retaining pin. The rotational damper, generally a cylindrical component, is received in a corresponding receiver of the seat fitting or lid fitting of compatible shape with a retaining portion, the connecting portion being rotatable in a damped manner relative to the retaining portion. In the mounted position, the axis of rotation runs horizontally and perpendicularly to the longitudinal axis of the retaining pin.

The respective connecting portions are expediently designed cylindrically and can be received in a receiver of the cover of compatible shape. Due to the positive connection, this makes it possible for the cover, which is potentially slightly rotated after being pushed on, to be automatically exactly aligned since it is entrained via the engaging connecting portion.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

BRIEF DESCRIPTION OF THE DRAWING

FIG. 3 shows a perspective view of the arrangement of FIG. 2 without the retaining pin screwed in, FIG. 4 shows a perspective view according to FIG. 3 with the retaining pin screwed in, FIG. 7 shows a perspective view of the arrangement of FIG. 6 without the retaining pin screwed in, FIG. 10 shows a partial view of a sanitary object according to the invention, illustrating the sanitary object with two fastening devices fastened thereto, still without the retaining pins screwed in, FIG. 12 shows the sanitary arrangement of FIG. 11 with the retaining pins screwed in and the covers not yet pushed on, and FIG. 13 shows the sanitary arrangement of FIG. 12 with the covers pushed on and the seat fitting or lid fitting not yet pushed on.

DETAILED DESCRIPTION OF THE INVENTION

Figure 1:
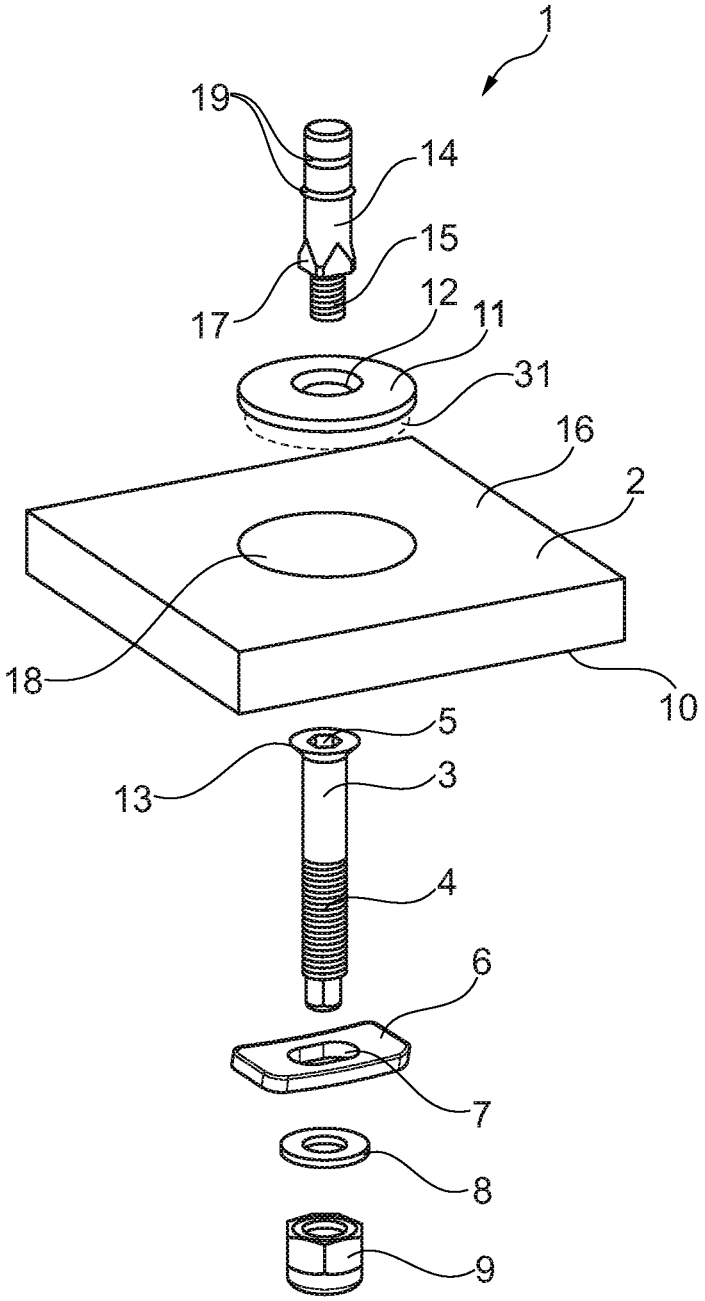
FIG. 1 shows a fastening device according to the invention of a first embodiment in an exploded view, with an indicated sanitary object.
Figure 2:
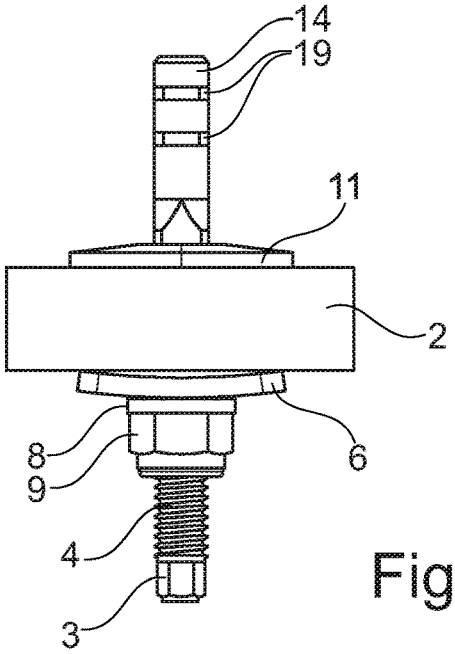
FIG. 2 shows the fastening device of FIG. 1 in the mounted state.

FIG. 1 shows an exploded view of a fastening device 1 according to the invention and a sanitary object 2 which is merely indicated, for example a WC. The fastening device 1 comprises a threaded rod 3 with an external threaded portion 4 extending over approximately half thereof and an internal threaded bore 5 axially incorporated on a front face. A first abutment element 6 is also provided, here in the form of a slightly curved plate, which abutment element 6 has a through-hole 7 so that it can be pushed onto the threaded rod 3. Also shown is a washer 8 which is also pushed onto the threaded rod 3 and a self-locking nut 9 which on the external threaded portion 4 serves for bracing the abutment portion 6 against the lower face 10 of the sanitary object 2.

The fastening device 1 also comprises at least one second abutment element 11 which is to be arranged, so to speak, on the other face of the sanitary object 2 and which is in the form of a circular disk with a preferably conically countersunk through-hole 12. The threaded rod 3 is guided through the through-hole, which will be explained below in detail, wherein the threaded rod 3 is supported in a countersunk and flush manner on the second abutment element 11 or in the through-hole 12 with a support portion 13 which is provided on its upper end and which is designed as a radially protruding shoulder and frustoconically in the example shown. Also provided is a retaining pin 14 with an external threaded portion 15 which can be screwed into the internal threaded bore 5. The internal threaded bore 5 is accessible from the upper face 16 of the sanitary object 2, since the threaded rod 3 is supported with the support portion on the abutment element 11, as described. The retaining pin 14 has a receiver 17 for a tool, for example a wrench, so that it can be correspondingly tightened. Instead of this square receiver 17, a slot can also be provided on the front face of the retaining pin 14 for receiving a tool. At this point it should be recorded that the second abutment element 11 can also be in one piece with the threaded rod 3, so that in this case a common component is formed, wherein a support portion 13 is then not required.

The sanitary object 2 itself has a round through-hole 18 through which the threaded rod 3 is guided for mounting, as described. In the final mounted position, the through-hole 18 is fully covered by the second abutment element 11 and thus is not visible. Naturally, two such through-holes for one respective fastening device 1 are provided on the sanitary object, in order to fix the seat fitting or lid fitting.

For the mounting, initially the threaded rod 3 is pushed through the through-hole 12 of the second abutment element 11, the threaded rod 3 being inserted thereafter through the through-hole 18 so that the abutment element 11 is positioned on the upper face 16 of the sanitary object 2. A plastics coating can be applied to the lower face of the abutment element 11, said plastics coating acting in a slightly damping manner since it is soft, so that scratching of the upper face 16, which is generally coated with a glaze, is avoided. Alternatively and optionally shown in dashed lines in FIG. 1, a contact washer 31 made of plastics can also be arranged as scratch protection between the abutment element 11 and the glazed surface.

After the threaded rod 3 is guided through the through-hole 18 from the lower face, the first abutment element 6 is pushed onto the threaded rod 3, followed by the washer 8, after which the self-locking nut 9 is finally screwed on. The nut 9 is tightened so that the sanitary object 2 is fixedly braced between the two abutments 6, 11. The bracing is possible since the threaded rod 3 is supported via the support portion 13 on the second abutment element 11, as described. Due to the slightly curved design of the first abutment element 6 it is pressed slightly flat when the nut 9 is tightened so that it is axially braced, which ensures that the screw connection is not released, in addition to the self-locking function of the nut 9. This mounted position is shown in the perspective view according to FIG. 3, which shows a view of the sanitary object 2 obliquely from above. It can be seen that the second abutment element 11 is positioned on the upper face 16 and the through-hole is fully covered. It is also shown that the frustoconical support portion 13 is received in a countersunk manner in the through-hole 12, which is also conical, so that the support portion 13 is virtually flush with the surface of the upper face of the support element 11.

This mounting situation corresponds to the mounting situation in the factory, i.e. all of the elements of the fastening devices, apart from the retaining pin 14, are pre-mounted on the sanitary object 2 which generally naturally has two through-holes 18, so that a WC seat fitting is fixed by means of two fastening devices 1. When mounted in the factory, the threaded rod 3 can be positioned exactly inside the through-hole which is significantly larger in terms of diameter, so that the two threaded rods 3 of the two fastening devices 1 can be optimally aligned and positioned in the factory, for example by using a mounting template or a mounting frame. Thus, on the one hand, the correct spacing therebetween can be set according to the spacing of the fastening elements on the seat fitting or lid fitting. On the other hand, the threaded rods 3 can be accurately oriented to the front and to the rear and on the two sides so that it is ensured that the seat fitting or lid fitting is then exactly aligned relative to the sanitary object 2.

Figure 3:
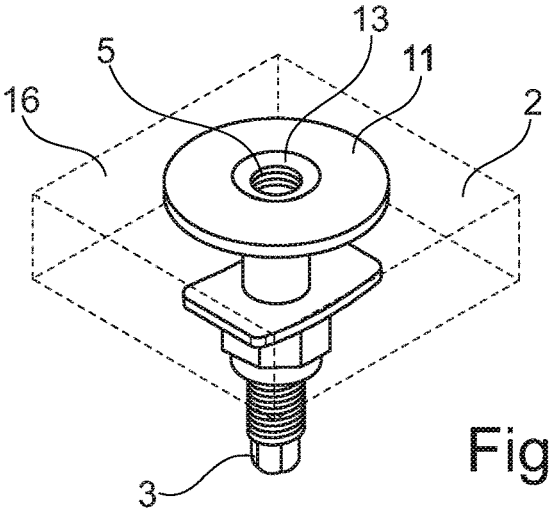
Figure 4:
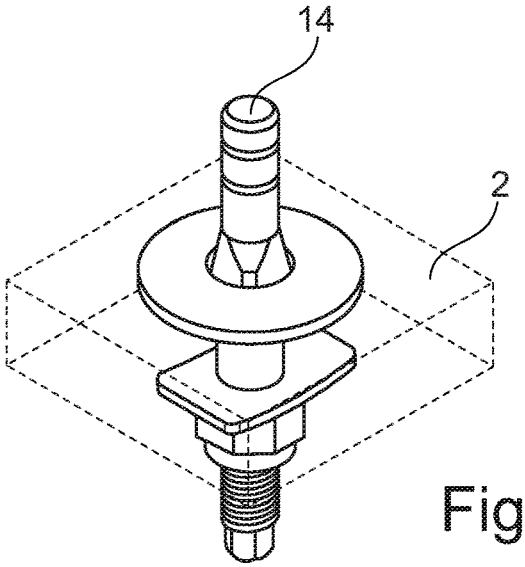

As described, FIG. 3 shows the mounting situation in the factory of the central parts of the fastening devices 1. In this form, the sanitary object 2 is packaged and transported and also removed and installed by the fitter in situ. Only when the sanitary object 2, i.e. the WC for example, is fastened to the wall, does the final mounting of the seat fitting or lid fitting finally take place. To this end, it is only necessary to screw the two retaining pins 14 into the internal threaded bore 5 which is freely accessible, see FIG. 3, and to tighten the retaining pins with a suitable tool. Since the threaded rods 3 are exactly aligned and positioned, this inevitably also applies to the screwed-in retaining pins 14 so that the fitter then only has to push the seat fitting or lid fitting onto the retaining pins 14, and any additional alignment operations are not required. The seat fitting or lid fitting is latched to the retaining pins, for example, latching grooves 19 being provided therefor on the pins, for example, and corresponding latching elements of the fastening elements of the seat fitting or lid fitting being snapped therein. FIG. 4 shows the final mounted position when the sanitary object 2 is mounted on the wall, for example. It can be seen that the retaining pin 14 is screwed into the internal threaded bore and tightened, and correspondingly protrudes from the sanitary object 2.

Figure 5:
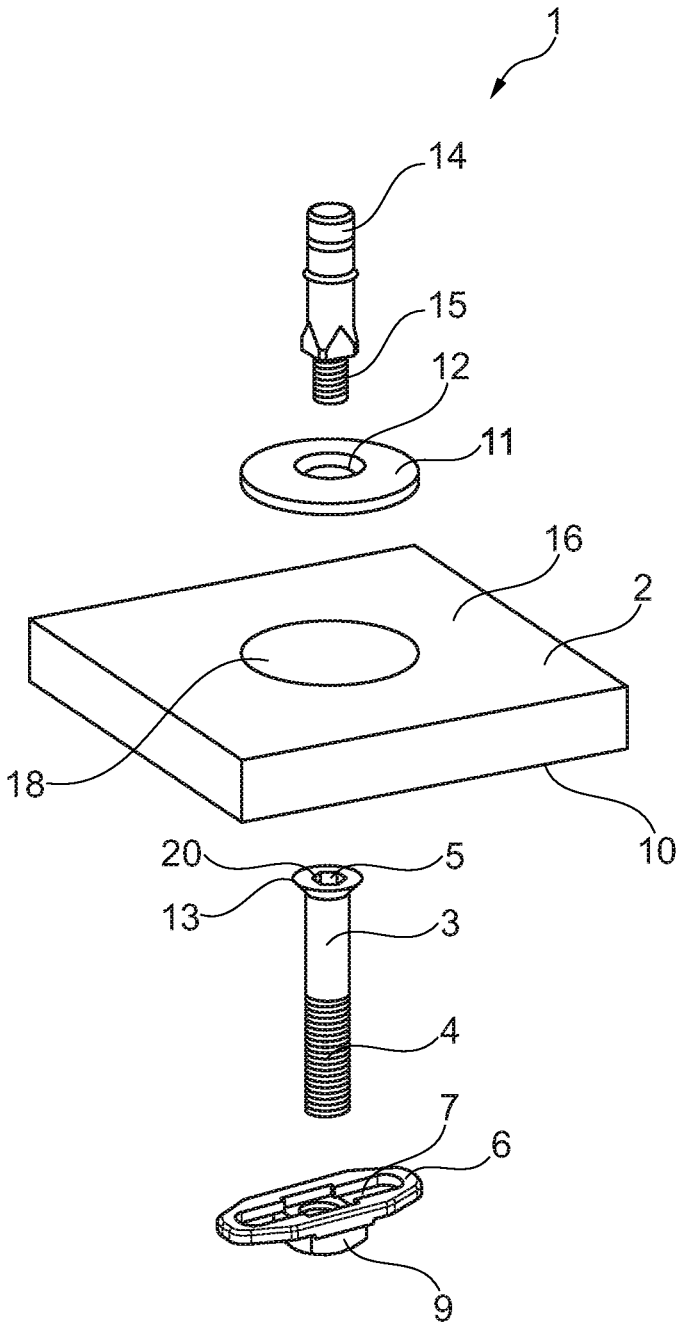
FIG. 5 shows a fastening device according to the invention of a second embodiment in an exploded view, with an indicated sanitary object.

FIG. 5 shows a further embodiment of a fastening device 1 according to the invention, wherein the same reference signs are used for the same components. A threaded rod 3 with an external threaded portion 4 and an internal threaded bore 5 are also provided here. A first abutment element 6 is shown here in an elongated shape, and it has an elongated slot-like through-hole 7 which is clearly longer than in the design according to FIG. 1. This elongated, slotted through-hole permits the plate-like first abutment element to function, so to speak, as a toggle fastener, further details thereof being provided below. Also provided is a nut 9 which is designed here as a square nut, for example.

Also provided is a second abutment element 11 with a through-hole 12 which in turn is conically countersunk, corresponding to the frustoconical geometry of the support portion 13 of the threaded rod 3. The retaining pin 14, which is screwed with its external threaded portion 15 into the internal threaded bore 5, is also provided.

The internal threaded bore 5 is provided in the example shown with a receiver 20 in the form of an internal hexagon for a tool such as an Allen key. This receiver 20 makes it possible to position a tool and either to rotate and screw the threaded rod 3 actively when bracing the components against the sanitary object 2, or to exert counter pressure when screwing the nut 9 and to lock the threaded rod accordingly.

During the course of the mounting, the threaded rod 3 is first inserted again through the through-hole 12 of the second abutment element. Then the first abutment element is pushed onto the threaded rod 3 and the nut 9 is screwed a short distance onto the threaded portion 4. Due to the length of the slotted through-hole 7, the first abutment element 6 can be tilted toward the threaded rod 3, i.e. the abutment element 6 does not protrude, so to speak, at right-angles to the side but runs relatively closely or tilted to the threaded rod 3. This makes it possible for this pre-mounted configuration to be able to be passed through the through-hole 18 of the sanitary object 2. As soon as the first abutment element 6 is pushed through the through-hole, it tilts again outwardly and is thus positioned on the nut 9 which is already slightly screwed on, but extends to the side of the threaded rod 3. After the second abutment element 11 is positioned on the upper face 16 of the sanitary object 2 and the support portion 13 is again received flush in the through-hole 12, the tightening begins. This can take place by a tool being inserted into the receiver 20 and the threaded rod 3 being rotated, as described, wherein the nut 9 can be secured and locked by a second tool. It is naturally also conceivable that only the nut 9 is rotated, while the threaded rod 3 is locked via the tool in the receiver 20. In any case, the first abutment element 6 is also braced against the lower face 10 and the second abutment element 11 is braced against the upper face 16 of the sanitary object, whereby the threaded rod 3 is fixed. This situation is shown in turn in FIG. 7 which corresponds to the arrangement according to FIG. 3. It can be clearly identified once again that the support portion 13 is received flush on the disk-shaped second abutment element 11 and that, on the one hand, the receiver 20 is exposed but, on the other hand, naturally also the internal threaded bore 5.

Figure 6:
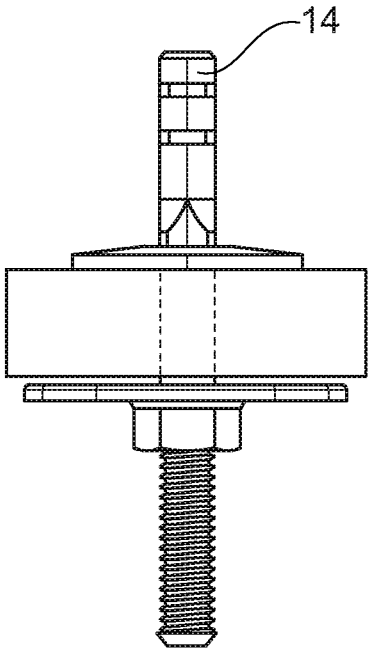
FIG. 6 shows the fastening device of FIG. 5 in the mounted state.
Figure 7:
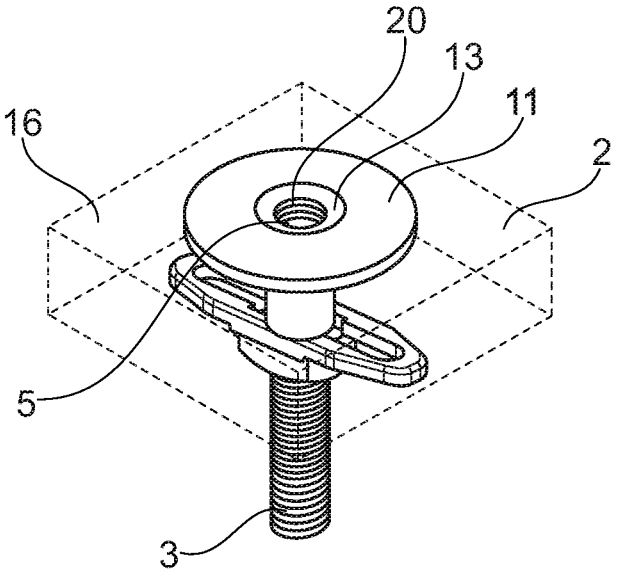

Starting from the pre-mounted position shown in FIG. 7, as the essential parts of the fastening device 1 are pre-mounted and aligned in the factory, after the WC mounting has taken place it is only necessary to screw in and tighten the retaining pins 14 in the internal threaded bores 5 of the two fastening devices 1, so that the retaining pins accordingly protrude from the sanitary object for the mounting of the fitting. The final mounting situation is shown in FIG. 6.

Figure 8:
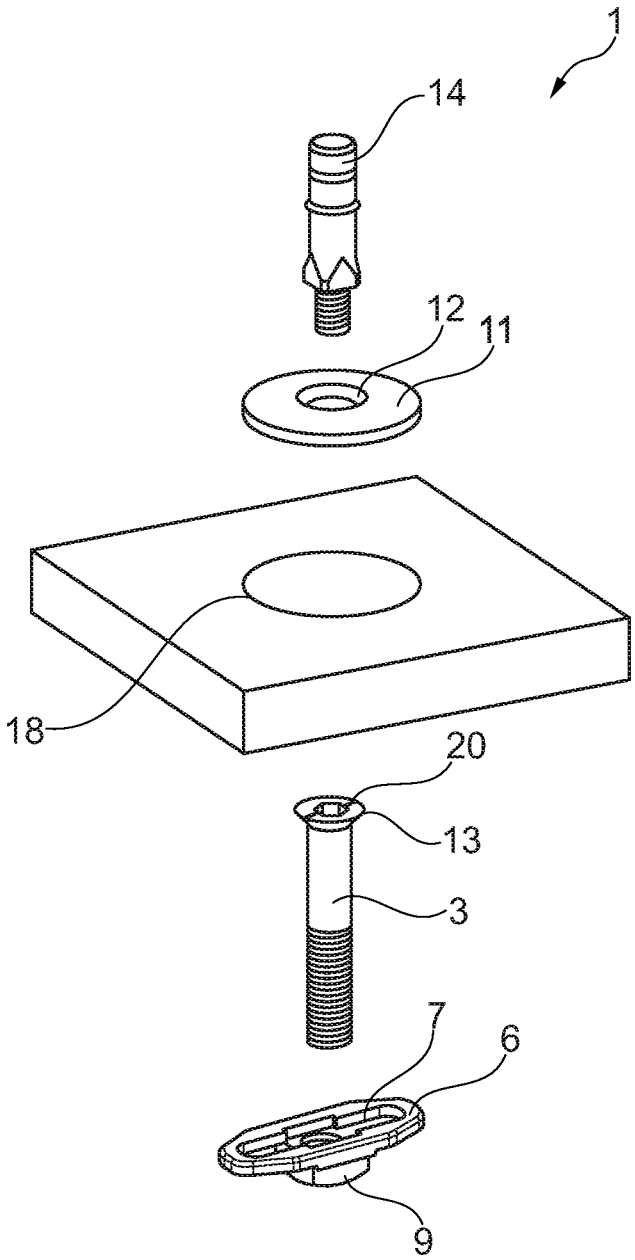
FIG. 8 shows a fastening device according to the invention of a third embodiment, in an exploded view with an indicated sanitary object.

FIG. 8 shows an embodiment of a fastening device 1 according to the invention which corresponds identically to that of FIG. 5, which is why reference is made to the description relative thereto. Only the design of the receiver 20 is different here, which permits a tool to be engaged on the threaded rod 3. The receiver 20 is designed as a slot which extends transversely on the front face of the support portion 13 and makes it possible for a screwdriver to engage therein. Otherwise, in addition to the threaded rod 3, also provided here is the first abutment element 6 in the form of the elongated plate-like component with the elongated slot 7 for producing a toggle fastener-like design, and the nut 9 and the second abutment element 11 with its through-hole 12 and the retaining pin 14. The mounting process takes place as described for the above embodiment according to FIG. 5. Here it is possible to use a different tool, namely a screwdriver, which is inserted into the slotted receiver 20 merely for screwing or locking the threaded rod 3.

Figure 9:
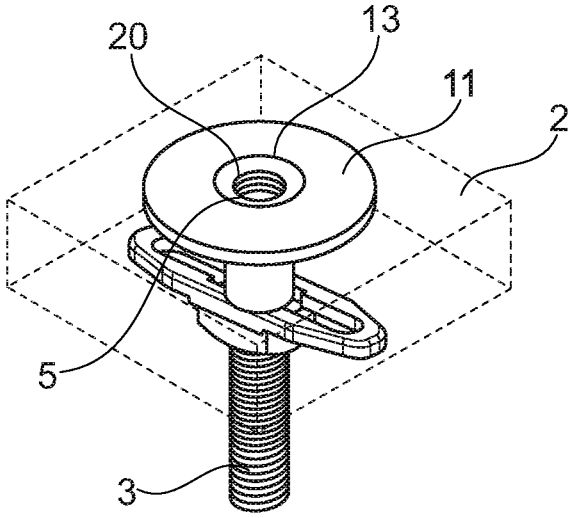
FIG. 9 shows a perspective view of the mounted fastening device without the retaining pin.

The situation pre-mounted in the factory is shown in FIG. 9. It can also be seen here once again that the support portion 13 is shown flush with the upper face of the second abutment element 11 which in turn fully covers the through-hole 18 in the sanitary object, due to the countersink in the through-hole 12. Also visible is the accessibility of the slotted receiver 20, which is open at the top, and the internal threaded bore 5. As described, it is now only necessary to screw in the retaining pin 14.

FIGS. 10-13 show in a partial view a sanitary arrangement 21 with a sanitary object 2, shown here in a partial view in the form of a WC. Two through-holes 18 in which the fastening devices 1 are already mounted, apart from the two retaining pins 14, are provided on the WC which is generally made of ceramic. The two disk-shaped second abutment elements 11 which lie flat on the upper face 16 of the sanitary object are shown. Optionally, as described, a plastics protective layer is applied to the lower face of the abutment elements 11 to avoid scratching the glazed coating, but alternatively a thin plastics disk can also be interposed. In any case FIG. shows the final position pre-mounted in the factory, which has already been shown relative to the above variants. The threaded rods 3, and therewith the threaded bores 5, are optimally positioned and aligned inside the significantly larger dimensioned through-holes 18, both relative to one another and to the front and rear face and on the two sides of the sanitary object 2. The sanitary object is packaged in this pre-mounted form in the factory, which is possible using hitherto used packaging means since the retaining pins 14 are not yet screwed in and, if they were to be already screwed on, would otherwise disadvantageously protrude. The handling is also simple and problem-free after unpacking, since the retaining pins do not hinder the subsequent handling and mounting process.

Figure 10:
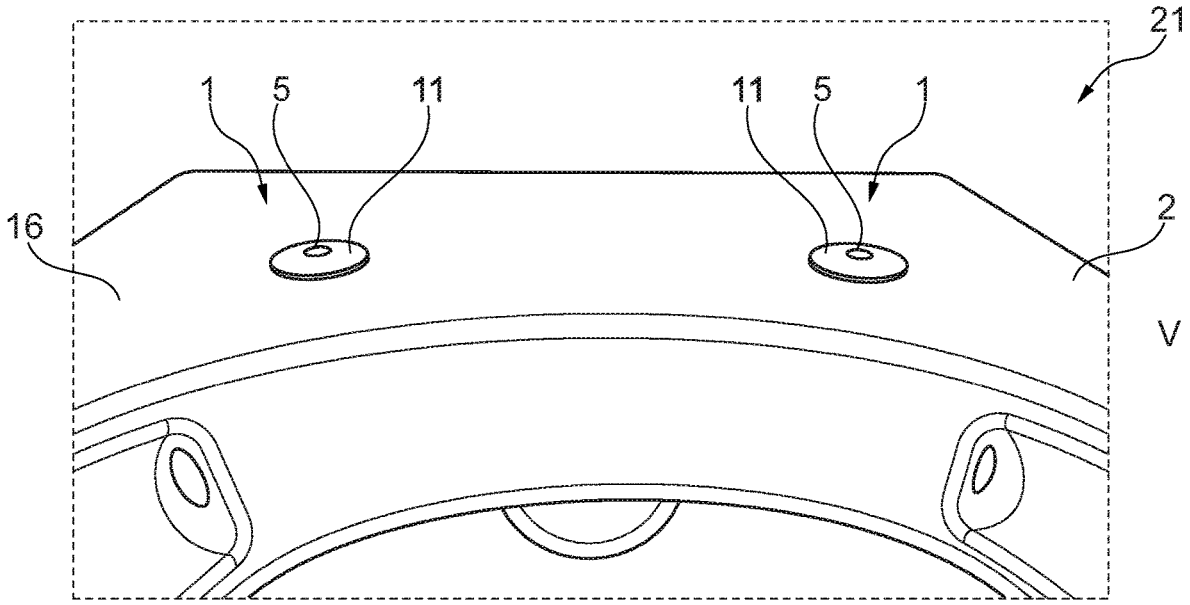
Figure 11:
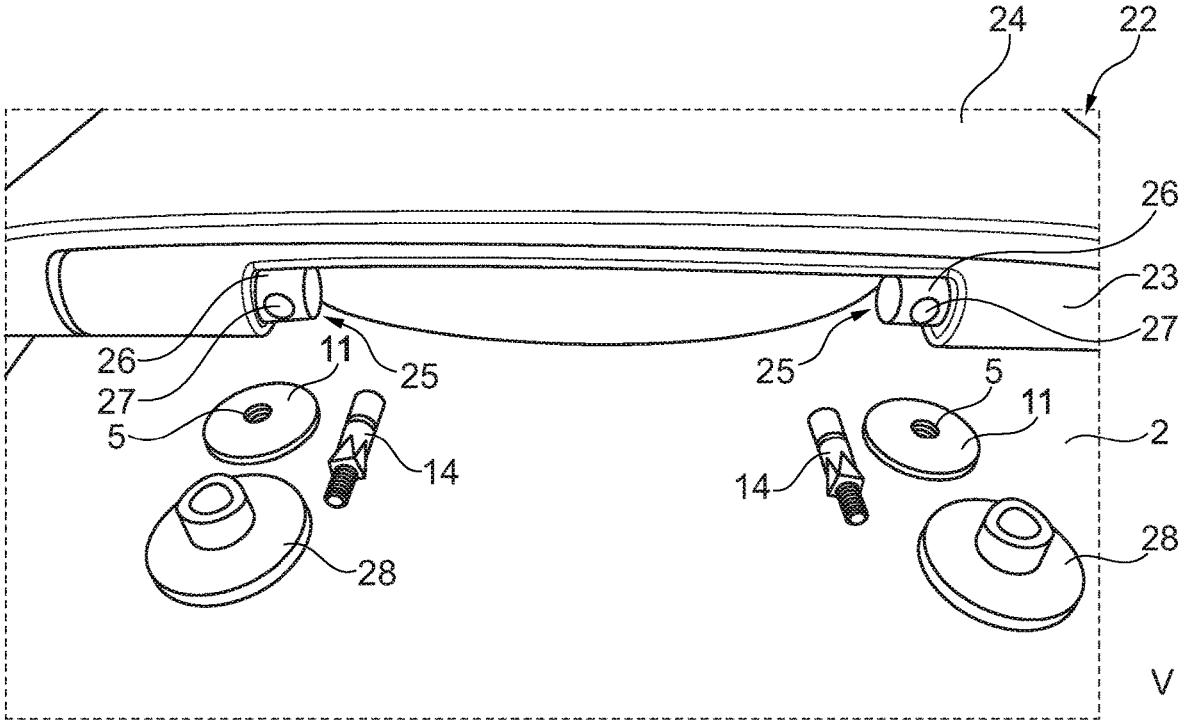
FIG. 11 shows the sanitary arrangement of FIG. 10 with the retaining pins not yet screwed in and the covers and the sanitary fitting not yet fastened.

As soon as the sanitary object 2 according to FIG. 10 is mounted on the wall, for example, and the corresponding inlet and outlet connections, etc. are connected and positioned, the actual mounting of the seat fitting or lid fitting takes place. FIG. 11 shows the sanitary object 2 and a combined seat-lid fitting 22 to be fastened thereto, the combined seat-lid fitting comprising a seat 23 and a lid 24 which are shown here in a detail and which are both pivotably movable relative to one another, two corresponding rotational dampers 25 being provided therefor in a manner known per se on the fitting 22. Each rotational damper has a connecting portion 26 with a blind bore 27 into which the retaining pins 14 are inserted and latched.

The two retaining pins 14, which are not yet screwed on, and two covers 28 made of plastics are shown in FIG. 11. These covers serve to cover, i.e. to conceal, the second abutment elements 11 and also the retaining pin 14 when screwed in, so that it is also not visible.

Figure 12:
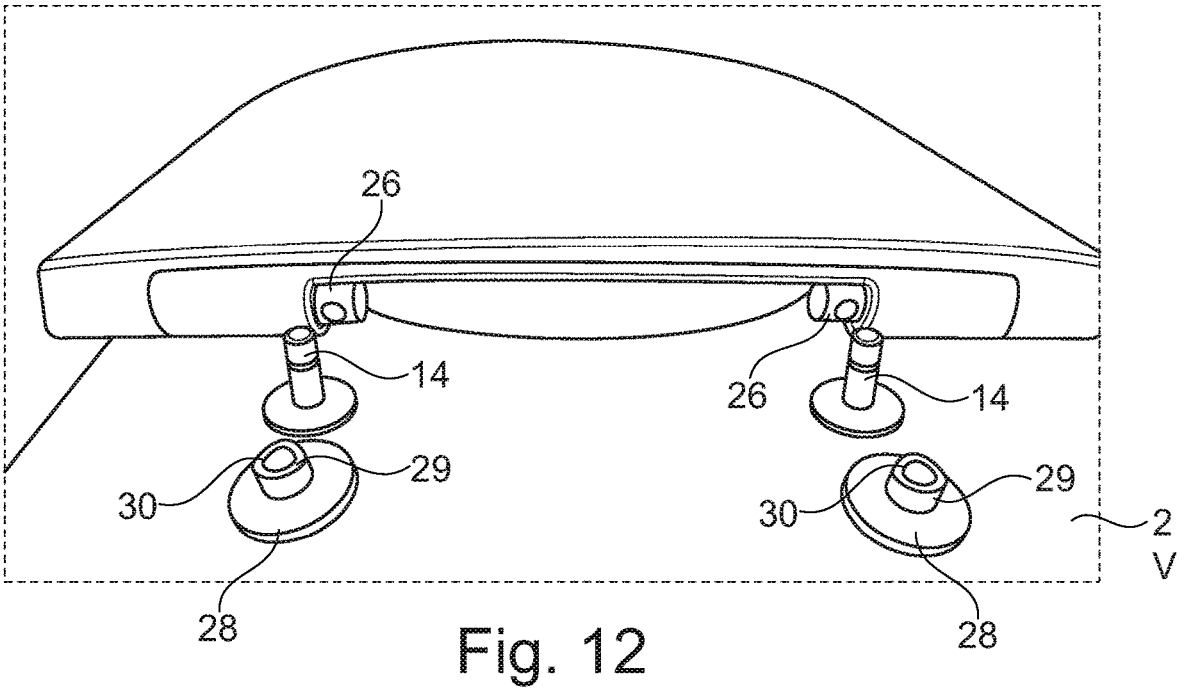
Figure 13:
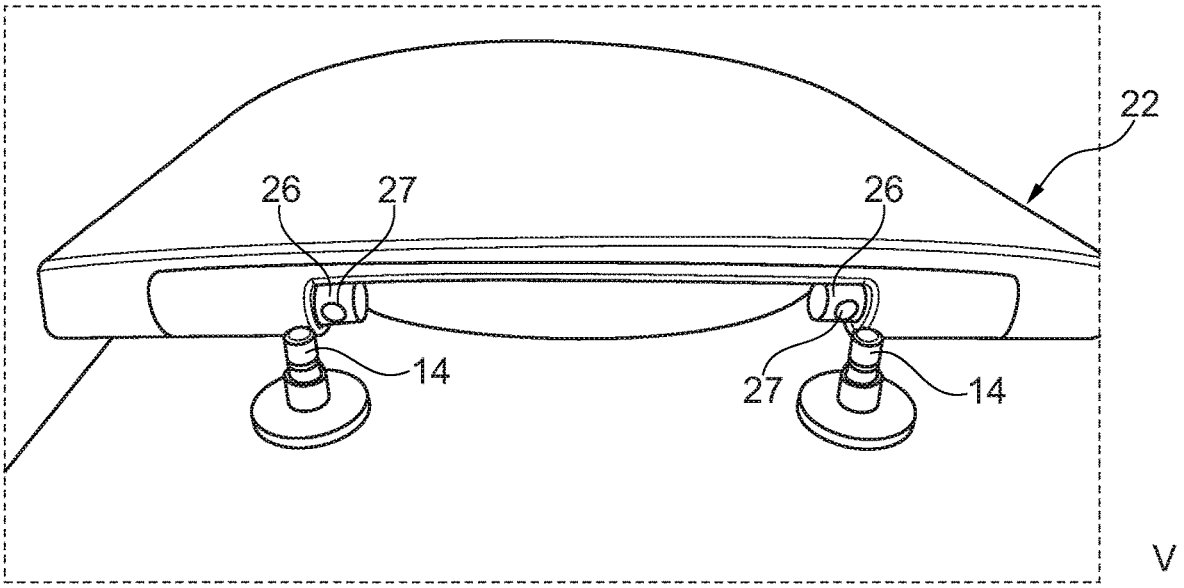

FIG. 12 shows the arrangement of FIG. 11, wherein here the two retaining pins 14 are screwed into the internal threaded bores 5 and protrude from the sanitary object 2. The covers 28 are then pushed over the retaining pins 14, see FIG. 13, so that, on the one hand, they cover the abutment elements 11 and, on the other hand, in some portions the respective retaining pin 14, each cover 28 having a cylindrical portion 29 therefor which encompasses the retaining pin 14 in some portions. This portion 29 is provided on its upper face with a rounded receiver 30 which corresponds to the cylindrical shape of the respective connecting portion 26 of the rotational damper 25.

For the final mounting of the seat-lid fitting 22, it is now positioned with the two blind bores 27 onto the two retaining pins 14 and latched thereto, wherein in the final latching position the cylindrical connecting portions 26 are received in the rounded receivers 30. If one of the covers 28 were to be slightly rotated about the axis of the retaining pin, this slight rotation would be correspondingly corrected and the cover 28 aligned due to this positive engagement of the cylindrical connecting portions 26 in the receivers 30. The covers 28 are simple plastics parts, while the other components of the fastening device 1 are metal components.

While specific embodiments of the invention have been shown and described in detail to illustrate the inventive principles, it will be understood that the invention may be embodied otherwise without departing from such principles.

I claim:

1. A fastening device for a seat fitting or lid fitting on a sanitary object, comprising a threaded rod which has an external threaded portion and an internal threaded bore and which engages through a through-hole in the sanitary object in the mounted position, a first and a second abutment element which in the mounted position receive a portion of the sanitary object between one another and are braced thereagainst, at least one nut to be screwed onto the external threaded portion for bracing the abutment elements and the threaded rod, and a one-piece retaining pin which receives the seat fitting or lid fitting and which has an external threaded portion to be screwed into the internal threaded bore.

2. The fastening device according to claim 1, wherein the threaded rod has a support portion by which it can be clamped against the second abutment element when the nut is screwed on, or in that the second abutment element is configured in one piece with the threaded rod.

3. The fastening device according to claim 1, wherein the first abutment element or the first and the second abutment element in each case is a disk or plate.

4. The fastening device according to claim 1, wherein the first and/or the second abutment element is captively retained on the threaded rod.

5. The fastening device according to claim 1, wherein the first abutment element has an elongated slot through which the threaded rod engages, so that the abutment element can be tilted toward the threaded rod.

6. The fastening device according to claim 2, wherein the support portion is a shoulder provided on the end of the threaded rod, the threaded rod bearing thereby against the second abutment element.

7. The fastening device according to claim 6, wherein the second abutment element has a recess for countersunk reception of the shoulder.

8. The fastening device according to claim 7, wherein the shoulder is conical and the recess is a conical countersink.

9. The fastening device according to claim 1, wherein a receiver is provided on the threaded rod for positioning a tool.

10. The fastening device according to claim 9, wherein the receiver is a slot which is provided on the front face of the threaded rod or a polygonal recess extending into the internal threaded bore.

11. The fastening device according to claim 1, wherein the second abutment element has a bearing portion which is made of a plastics material and which bears against the sanitary object, or in that the second abutment element is supported against the sanitary object via a bearing disk made of a plastics material.

12. The fastening device according to claim 1, wherein the retaining pin has a receiver for positioning a tool.

13. The fastening device according to claim 12, wherein the receiver is a slot provided on the front face of the retaining pin or a polygonal pin section.

14. The fastening device according to claim 1, wherein the retaining pin has one or more clamping or latching elements for a clamped or latching retention of the seat fitting.

15. The fastening device according to claim 1, wherein a cover is provided, the cover being placed on the second abutment element and covering this second abutment element in the mounted position, and the retaining pin engaging therethrough.

16. A sanitary arrangement comprising a sanitary object and a seat fitting or lid fitting which is fastened or can be fastened to the sanitary object by means of two fastening devices according to claim 1.

17. The sanitary arrangement according to claim 16, wherein two preferably round through-holes, which are fully covered in the mounted position by the second abutment element or by the cover, are provided on the sanitary object.

18. The sanitary arrangement according to claim 16, wherein the sanitary object is a WC or bidet.

19. The sanitary arrangement according to claim 16, wherein the seat fitting or lid fitting has only one seat, only one lid or a seat-lid combination.

20. The sanitary arrangement according to claim 16, wherein two rotational dampers, which in each case have a connecting portion with a retaining pin receiver into which the respective retaining pin engages, are fastened to the seat fitting or lid fitting.

21. The sanitary arrangement according to claim 20, wherein the respective connecting portions are received in a receiver of the cover of compatible shape.

* * * * *